US005420675A

United States Patent [19]

Thompson et al.

[11] Patent Number: 5,420,675

[45] Date of Patent: May 30, 1995

[54] LIQUID TONER FUSING/TRANSFER SYSTEM WITH A FILM-FORMING ROLLER THAT IS ABSORBENT OF A LOW VOLATILITY LIQUID TONER CARRIER

[75] Inventors: John A. Thompson; C. S. Chan; Kenneth E. Heath, all of Boise, Id.

[73] Assignee: Hewlett-Packard Company, Palo Alto, Calif.

[21] Appl. No.: 210,813

[22] Filed: Mar. 16, 1994

[51] Int. Cl.[6] ..... G03G 15/10

[52] U.S. Cl. ..... 355/256; 118/652; 355/296; 430/117

[58] Field of Search ..... 355/256, 261, 296, 298; 118/647, 651, 652, 661; 430/117-119

[56] References Cited

U.S. PATENT DOCUMENTS

| | | | |
|---|---|---|---|
| 3,839,032 | 10/1974 | Smith et al. | 96/1.4 |
| 3,955,533 | 5/1976 | Smith et al. | 355/298 X |
| 4,218,246 | 8/1980 | Tanaka et al. | 430/117 |
| 4,286,039 | 8/1981 | Landa et al. | 430/119 |
| 4,325,627 | 4/1982 | Swidler et al. | 355/256 |
| 4,337,303 | 6/1982 | Sahyun et al. | 430/11 |
| 4,684,238 | 8/1987 | Till et al. | 355/275 |
| 4,708,460 | 11/1987 | Langdon | 355/271 |
| 4,727,394 | 2/1988 | Bov, Jr. et al. | 355/290 |
| 4,731,635 | 3/1988 | Szlucha et al. | 355/283 |
| 4,731,636 | 3/1988 | Howe et al. | 355/298 |
| 4,733,272 | 3/1988 | Howe et al. | 355/291 |
| 4,745,432 | 5/1988 | Langdon | 355/290 |
| 4,796,048 | 1/1989 | Bean | 355/277 |
| 4,842,972 | 6/1989 | Tavernier et al. | 430/117 |
| 4,863,543 | 9/1989 | Shiozawa et al. | 156/235 |
| 4,891,677 | 1/1990 | Shiozawa et al. | 355/280 |
| 4,897,691 | 1/1990 | Dyer et al. | 355/288 |
| 4,931,334 | 6/1990 | Shiozawa et al. | 428/137 |
| 4,947,215 | 8/1990 | Chuang | 355/274 |
| 4,974,027 | 11/1990 | Landa et al. | 355/256 |
| 5,021,834 | 6/1991 | Tsuruoka et al. | 355/256 |
| 5,136,334 | 8/1992 | Camis et al. | 355/256 |
| 5,204,722 | 4/1993 | Thompson et al. | 355/279 |

OTHER PUBLICATIONS

"Exxon Petroleum Solvents," Lubetext DG-1P, Jan. 1983, pp. 1-7.

*Primary Examiner*—A. T. Grimley
*Assistant Examiner*—William J. Royer

[57] ABSTRACT

An electrostatic imaging system includes a photoconductor which carries an image defined by a liquid toner. The liquid toner comprises a pigment binder system in a paraffinic solvent blend carrier liquid, the liquid carrier exhibiting a relatively high flash point temperature. The imaging system further includes a heating roll, and a film forming roll positioned between the photoconductor and the heating roll. The film forming roll includes at least first and second superposed layers, the first layer comprised of a material that is carrier liquid phillic and which exhibits a dimensional thickness which enables substantially all carrier liquid entrained therein to reach the liquid's flashpoint temperature when under influence of the heating roll. The second layer is carrier liquid phobic and exhibits a resiliency that enables the first layer to compliantly mate with the photoconductor surface. A further transfer roll comprises an outer, liquid carrier phobic layer and an inner compliant layer for enabling indirect transfer of an image from the photoconductor to a media sheet.

9 Claims, 1 Drawing Sheet

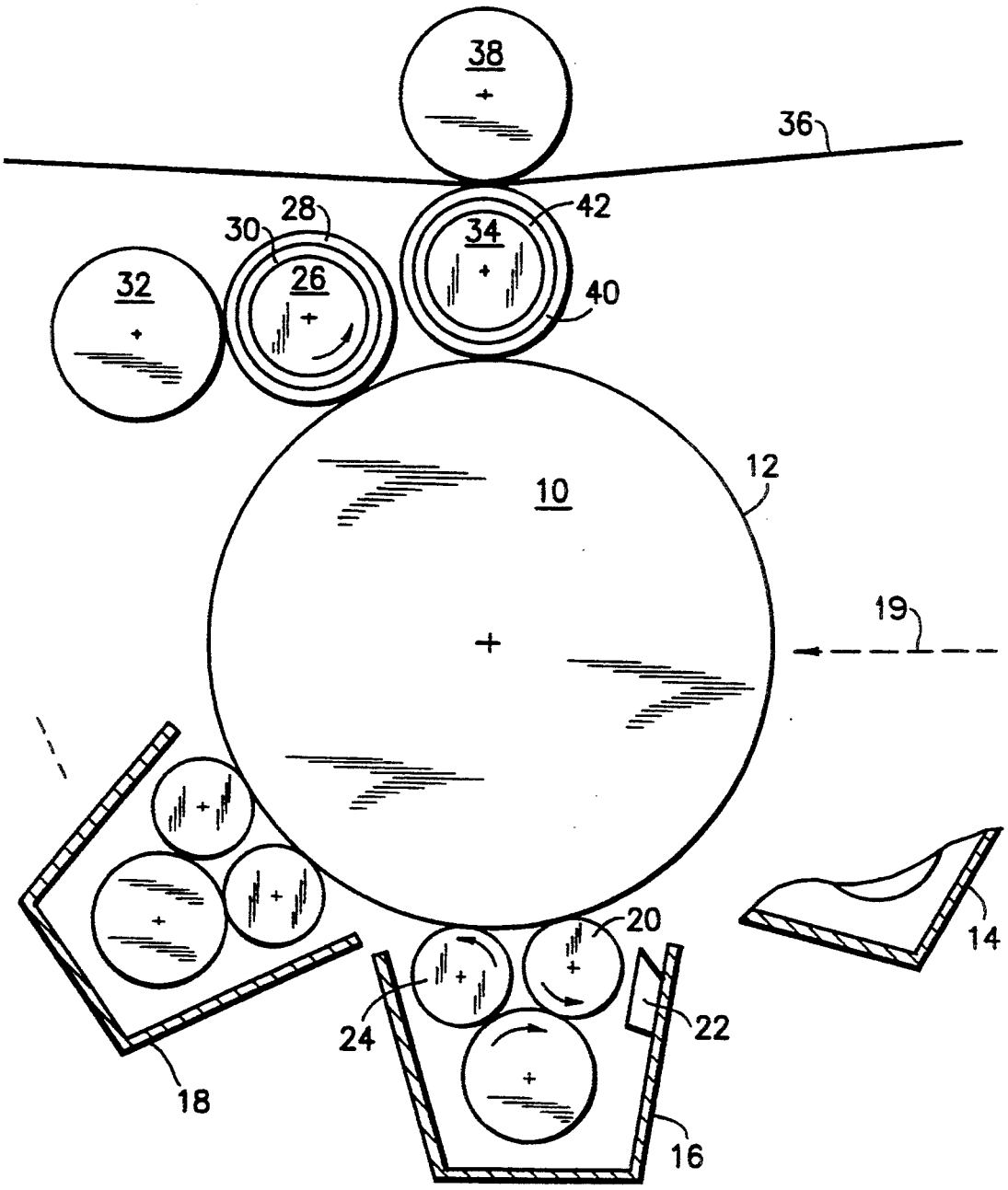
38
36
42
28
30
34
26
32
40
12
10
19
20
14
24
22
18
16

LIQUID TONER FUSING/TRANSFER SYSTEM WITH A FILM-FORMING ROLLER THAT IS ABSORBENT OF A LOW VOLATILITY LIQUID TONER CARRIER

FIELD OF THE INVENTION

This invention relates to a liquid toner electrostatic imaging system and, more particularly, to a system for fusing and transferring a low volatility liquid toner from a photoconductor surface to a media sheet.

BACKGROUND OF THE INVENTION

Electrophotographic processes that produce full color presentations are increasingly turning to the use of liquid toners. In a liquid toner, charge control agents are chemically added to a carrier which contains pigment-/binder components. A subsequent chemical reaction between the charge control agents and the pigment-/binder components results in a charging of the pigment/binder components. The liquid toner is, per se, electrically neutral, however once an electric field is applied, charged particles migrate towards opposite electrodes. Many prior art liquid toner systems have employed a liquid carrier-wetted paper to allow for the mobility of the toner particles and counter charges. (Images that are completely dry become neutral as there is no charge mobility—without the liquid carrier.)

Liquid carriers used with liquid toners have characteristically exhibited high volatility. Such a highly volatile carrier liquid is easily evaporated by heat, pressure and/or air flow, thereby assuring a dry media sheet upon completion of the printing process. One volatile carrier that is widely used is Isopar G, a product of the Exxon Corporation. Such volatile carriers are flammable and consequently are impacted by today's strict regulations regarding the handling of flammable materials. Systems employing volatile carriers can be found in the following U.S. Pat. Nos.: 4,947,215 to Chuang; 4,708,460 to Langdon et al; 4,897,691 to Dyer et al.; 4,842,972 to Tavernier et al; 4,733,272 to Howe et al; 4,731,636 to Howe et al.; 4,731,635 to Szlucha et al; 4,796,048 to Bean; 4,727,394 to Bov, Jr., et al.; 4,745,432 to Langdon; 3,839,032 to Smith et al.; and 4,325,627 to Swidler et al.

Certain liquid toner systems employ an adhesive transfer approach which uses a sacrificial transfer means requiring a replenishable transfer media (see U.S. Pat. Nos. 4,337,303 to Sahyun et al.; and 4,863,543; 4,891,677 and 4,931,334 to Shiozowa et al.) U.S. Pat. No. 4,684,238 to Till et al. employs an intermediate transfer process, however the liquid toner drying process employs an electrically biased metering roll juxtaposed to an intermediate belt. Such a drying process is mainly effective when using a high volatility carrier liquid.

Lower volatility carrier liquids have been employed with liquid toners. To remove liquid from such toner deposits, the prior art has suggested the use of reverse rollers and a polyurethane roller which acts as a "blotter" to absorb excess developer liquid from a developed latent electrostatic image on a photoconductive surface. Such a system is shown in U.S. Pat. No. 4,286,039 to Landa et al. Landa et al. employ a closed cell urethane foam material with open surface cells for picking up the carrier liquid. Such a system creates image defects and non-uniform drying due to the texture of the roller.

U.S. Pat. No. 4,974,027 to Landa et al. discloses a liquid toner system employing an intermediate transfer roller which incorporates an external squeegee/rigidizing roller and an intermediate transfer roller. Both rollers rely on some image wetness to permit electrophoretic charging to maintain a toned image's integrity as it passes through each roller. More particularly, the intermediate transfer roller described by Landa et al. accumulates the four color planes from the electrophotographic surface and only then transfers the color image to a media sheet.

In U.S. Pat. No. 5,204,722 to Thompson et al., a system is described for transfer of wet toner images to paper directly from a photoconductor surface. It has been found, however, that achieving complete transfer of an image from a photoconductor surface to any surface other than smooth paper is difficult.

Accordingly, it is an object of this invention to provide an improved color electrophotography system employing a relatively non-volatile liquid toner.

It is another object of this invention to provide a color electrophotography system wherein complete image transfer is assured between a toned photoconductive service and a media sheet.

It is yet another object of this invention to provide an image transfer mechanism for a liquid toner which does not rely upon electrophoretic charge movement during the transfer process.

SUMMARY OF THE INVENTION

An electrostatic imaging system includes a photoconductor which carries an image defined by a liquid toner. The liquid toner comprises a pigment binder system in a paraffinic solvent blend carrier liquid, the liquid carrier exhibiting a relatively high flash point temperature. The imaging system further includes a heating roll, and a film forming roll positioned between the photoconductor and the heating roll. The film forming roll includes at least first and second superposed layers, the first layer comprised of a material that is carrier liquid phillic and which exhibits a dimensional thickness which enables substantially all carrier liquid entrained therein to reach the liquid's flashpoint temperature when under influence of the heating roll. The second layer is carrier liquid phobic and exhibits a resiliency that enables the first layer to compliantly mate with the photoconductor surface. A further transfer roll comprises an outer, liquid carrier phobic layer and an inner compliant layer for enabling indirect transfer of an image from the photoconductor to a media sheet.

DESCRIPTION OF THE DRAWINGS

The FIGURE is a schematic drawing of a full color electrophotography system that incorporates the invention hereof.

DETAILED DESCRIPTION OF THE INVENTION

The liquid toner employed in this invention utilizes a liquid carrier that exhibits a relatively high temperature flashpoint. As such, the liquid carrier is substantially non-flammable and does not exhibit the high volatility of other commonly used liquid toner carriers. It therefore becomes more difficult to assure that a toned image is "dry" during a subsequent transfer procedure. The liquid carrier is a paraffinic solvent blend, is typically oleophilic, chemically stable under a variety of conditions and is electrically insulating. More specifically, the carrier liquid has a low dielectric constant and a high electrical resistivity. The most preferred carrier liquid sold under the name NORPAR 12 (a trademark of the Exxon Corporation). NORPAR 12 is a narrow-cut 188°–217° C. (370°–422° F.) boiling range, normal-paraffinic solvent composed primarily of $C_{11}$ and $C_{12}$ hydrocarbons. NORPAR 12 exhibits a flashpoint temperature of 69° C. (as compared to prior art electrophotography systems which have used various ISOPAR solvents which exhibit flashpoints less than 55° C). NORPAR 12 exhibits an evaporation rate that is an order of magnitude less than the various ISOPAR liquid carriers—thereby indicating its much lower volatility. While NORPAR 12 will be hereafter referred to as the most preferred carrier liquid, it is to be understood that any other paraffinic solvent blend exhibiting similar characteristics is also within the range of preferred carrier liquids.

Toner particles employed with the carrier liquid are comprised of a colorant embedded in a thermoplastic resin core. The colorant may be a dye or more preferably, a pigment. The resin may be comprised of one or more polymers or copolymers which are characterized as being generally insoluble or only slightly soluble in the carrier liquid. The toner composition further includes a charge control agent, sometimes referred to as a charge director, to provide uniform charge polarity of the toner particles. The charge director acts to impart an electrical charge of selected polarity to the toner particles.

Turning now to FIG. 1, a drum 10 has an organic photoconductor 12 coated on the surface thereof. In addition, and while not specifically shown, photoconductor 12 is covered by a release coating (e.g., a silicone polymer). A plurality of color developer modules 14, 16, 18, etc. are positioned about the periphery of drum 10 and enable individual liquid toners contained therein to be placed on an image-wise charged surface of photoconductor 12. A laser beam 19 applies an image charge state, in the known manner, to photoconductor 12. In accordance with known charge management procedures, either a discharge area development or a charge area development procedure may be employed.

A printer controller (not shown) selectively controls laser beam 19 to apply image wise signals to photoconductor 12 that are consistent with stored color plane images. In the known manner, a first color plane is accessed and controls laser beam 19 to apply image signals in accordance with the color plane's pixel data. After such exposure, drum 10 rotates the imaged areas into juxtaposition with a color developer module containing a toner whose color matches the color of the color plane. That color developer module is then brought into engagement with photoconductor surface 12 and causes a toning of the imaged area. The means for moving each color developer module into and out of engagement with photoconductor surface 12 are omitted as they are known in the art.

Each color developer module includes a developer roller 20 which receives liquid toner through a plenum supply 22 and applies it to photoconductor surface 12 in accordance with a charge state present thereon. A squeegee roller 24 compresses the liquid toner onto the surface of photoconductor 12 and causes some of the excess liquid to fall back into the developer module. The single color toned image is then moved by rotation of drum 10 into engagement with a film forming roll 26. When the liquid toned image departs from a developer module, substantial carrier liquid is still present in the toner. Because the toner's liquid carrier is relatively non-volatile, the application of heat alone has been found to be insufficient to remove the liquid carrier before it reaches an image transfer point.

To remove excess liquid carrier, film forming roller 26 is provided with a pair of concentric layers. The first and outermost layer 28 is extremely thin and comprises a liquid carrier phillic material which absorbs the liquid carrier upon contact. A second and underlying layer 30 comprises a resilient, liquid carrier-phobic material which, provides a resiliency for liquid carrier phillic surface 28, enabling compliance between first layer 28 and the toned image on photoconductor surface 12. A heated cleaning roll 32 is in compression contact with first layer 28 and provides both a source of heat to film forming roll 26 and a compressive action that removes liquid toner from first layer 28.

Functionally, first layer 28 performs a sponge-like action with respect to liquid carrier on the surface of photoconductor 12. However, to prevent subsequent image contamination, all liquid carrier from first layer 28 must be removed by cleaning roll 32, in one pass. Liquid carrier removal occurs principally at the nip between film forming roll 26 and cleaning roll 32. Cleaning roll 32 is heated to a sufficient temperature so that, at the point of contact between first layer 28 and cleaning roll 32, substantially all liquid carrier entrained within layer 28 is heated to a temperature above its flashpoint. In the case of NORPAR 12, that temperature must exceed 69° C. As a result, a preferred temperature for cleaning roll 32 is approximately 90° C.

The thickness of first layer 28 must be sufficiently thin to enable substantially all liquid-carrier entrained therein to be raised above the flashpoint temperature. A preferred thickness range for first layer 28 lies between 25–500 microns and is most preferably approximately 50 microns. To capture the evaporated liquid carrier, an enclosure is provided about film forming roll 26 and heating roll 32 (not shown).

The temperature of heating roll 32 must be sufficiently moderate so that it does not raise the temperature of film forming roll 26 to a temperature that will injure photoconductor 12. Preferably, film forming roll 26 is not brought above a temperature of 50° C. through the action of cleaning roll 32.

The most preferred material for first layer 28 is a silicone rubber. Preferred silicone rubbers may be obtained from the Mobay Chemical Corporation, Pittsburgh, Pa. and are as follows: Mobay 48V750 or a Silicone/EPDM blend (Mobay 48V750/EPCAR 346). The indication of "EDPM" describes an ethylene propylene class of polymers. The "EM" designate the presence of certain diene monomers acting as cure sites for sulfur vulcanization. The preferred silicone rubber is polydimethysiloxane hydroxy terminated.

Second layer 30 (which is liquid carrier phobic) is preferably either a fluorosilicone rubber or a nitrile rubber. Both of those rubbers are "phobic" to the liquid carrier (e.g. NORPAR 12) and do not allow a migration thereof into the compliant undercoating. A preferred fluorosilicone rubber is Ames Compound 9031B available from Ames Rubber Corporation, Hamburg, N.J. A preferred nitrile rubber is Ames Compound 8300C available from Ames Rubber Corporation. The thickness of the second layer 30 is preferably approximately 1 mm.

The surface finish of liquid first layer 28 is mirror-like and provides intimate contact with the toner layer on photoconductor surface 12. Thus, the combination of heat applied by film forming roll 26 and the absorption of excess liquid carrier by the liquid-carrier phillic surface of first layer 28 enables the removal of excess liquid carrier from the toned imaged. The elevation of the temperature past the flashpoint of the liquid carrier within first layer 28 by cleaning roller 32 causes the liquid carrier to be volatilized and to be thus removed from first layer 28.

Film forming roller 26 must exhibit release characteristics for the toner film on photoconductor surface 12. A hardness of 40 Shore A exhibited by first layer 28 will provide a desired release property.

Once the toned image has had the excess liquid carrier removed by film forming roll 26, it proceeds to a transfer roller 34. Transfer roller 34 only comes into contact with photoconductive surface 12 after all four colors (KCMY) have been overcoated on the surface of photoconductor 12. At such point, the image is ready for transfer to sheet media 36. Under such a condition, intermediate transfer roller 34 (with a heated backup roll 38) is brought into contact with photoconductor surface 12.

The adhesive properties of the toner on photoconductor surface 12 are controlled by the drying function action by film forming roll 26. When the toner is very wet with the liquid carrier, the toner film is not tacky. Completely dry, fused toner layers also have low tack. Film forming roller 26, by substantially drying the toner to form the film, but not to completely dry it, maximizes surface tack.

Intermediate transfer roller 34 comprises an outer fluorosilicone layer 40 that is liquid carrier phobic. As a result, there is no uptake in layer 40 of the liquid carrier that remains on the surface of photoconductor 12. An underlayer 42 is preferably a silicone rubber which enables a desired level of compliancy between liquid carrier-phobic layer 40 and photoconductor surface 12. As a result of disparate surface energies, outer layer 40 lifts off the toner film from the release surface of photoconductor 12.

Once the toned image has been transferred to liquid carrier phobic layer 40, it is transferred to media sheet 36 (e.g., paper, etc.). Media sheet 36 is pressed between transfer roller 34 and heated backup roller 38 under substantial pressure, temperature to enable transfer of the toner film to media sheet 36.

A preferred material for outer layer 40 is a fluoro-silicone rubber DC94003 available from the Dow Corning Corp, Midland, Mich. DC94003 exhibits a proper hardness to conform macroscopically under pressure to the topology of media sheet 36. This property causes the transferred image to have a similar surface gloss as the media to which the toner is transferred.

A variety of fluorosilicone rubbers have been tried as outer layer 40 on transfer roller 34. Many have exhibited less than 100% transfer efficiency between the release layer of photoconductive surface 12 and layer 40. The Dow Corning DC 94003 fluorosilicone provides excellent transfer characteristics. A preferred thickness for outer layer 40 is approximately 250 microns. A preferred material for under layer 42 is a silicone rubber.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrostatic imaging system, comprising:

a photoconductor carrying an image defined by a liquid toner, said liquid toner comprising a pigment binder system in a paraffinic solvent blend carrier liquid, said carrier liquid exhibiting a flashpoint temperature;

a heating roll;

a film forming roll in contact with said photoconductor and said heating roll, and including at least first and second superposed layers, said first layer comprised of a material that is carrier liquid phillic and exhibits a dimensional thickness about said film forming roll which enables substantially all carrier liquid entrained therein to reach a flashpoint when under influence of said heating roll, said second layer being carrier liquid phobic and exhibiting a resilient characteristic.

2. The electrostatic imaging system of claim 1, wherein said first layer comprises a silicone rubber and said second layer comprises either a fluorosilicone or a nitrile rubber.

3. The electrostatic imaging system of claim 1 wherein said carrier liquid is non flammable, electrically insulating and exhibits a flashpoint in excess of 60° C.

4. The electrostatic imaging system of claim 3 wherein said heating roll is heated to a temperature greater than the flashpoint of said carrier liquid but less than a temperature which raises said temperature of said film forming roll to a level that injures said photoconductor.

5. The electrostatic imaging system of claim 1 wherein said carrier liquid is a normal paraffinic solvent composed primarily of $C_{11}$ and $C_{12}$ hydrocarbons and having a boiling range of 188°–217° C.

6. The electrostatic imaging system of claim 5 wherein said first layer exhibits a thickness in the range of 25 to 500 microns.

7. The electrostatic imaging system of claim 1 further comprising:

a transfer roll in contact with said photoconductor and including at least outer and inner superposed layers, said outer layer comprised of a material that is carrier liquid phobic, said inner layer being resilient so as to enable compliance of said outer layer to said photoconductor.

8. The electrostatic imaging system of claim 7 wherein said outer layer is a fluorosilicone rubber.

9. The electrostatic imaging system as recited in claim 8 wherein said outer layer exhibits a thickness of approximately 250 microns.

* * * * *